US007140905B2

(12) United States Patent
Castaldo

(10) Patent No.: US 7,140,905 B2
(45) Date of Patent: Nov. 28, 2006

(54) QUICK WIRE CONNECT ANGLE PLUG

(75) Inventor: Cosmo Castaldo, Westbury, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/969,579

(22) Filed: Oct. 20, 2004

(65) Prior Publication Data

US 2005/0287862 A1 Dec. 29, 2005

Related U.S. Application Data

(60) Provisional application No. 60/516,621, filed on Oct. 31, 2003.

(51) Int. Cl.
*H01R 4/24* (2006.01)

(52) U.S. Cl. ..... 439/410; 439/409; 439/696; 439/467; 439/395

(58) Field of Classification Search ..... 439/410, 439/409, 696, 687, 467, 466, 596, 395
See application file for complete search history.

(56) References Cited

U.S. PATENT DOCUMENTS 3,335,394 A * 8/1967 Miller ..... 439/465
4,413,872 A * 11/1983 Rudy et al. ..... 439/467
4,759,723 A * 7/1988 Siemon ..... 439/409
4,842,546 A * 6/1989 Song ..... 439/409
5,217,389 A * 6/1993 MacKay et al. ..... 439/466
5,246,381 A * 9/1993 Tashiro et al. ..... 439/395
5,252,081 A * 10/1993 Hart ..... 439/98
5,514,006 A * 5/1996 Getselis et al. ..... 439/417
6,074,238 A * 6/2000 DeRoss et al. ..... 439/409
6,113,421 A * 9/2000 Daoud ..... 439/459
6,126,478 A * 10/2000 Presson et al. ..... 439/467
6,544,070 B1 * 4/2003 Radliff ..... 439/596
6,695,639 B1 * 2/2004 Castaldo et al. ..... 439/467
2002/0002002 A1 * 1/2002 Okabe et al. ..... 439/596
2004/0110426 A1 * 6/2004 Castaldo et al. ..... 439/696
2004/0235335 A1 * 11/2004 Schoeffel et al. ..... 439/410

* cited by examiner

*Primary Examiner*—Gary F. Paumen
(74) *Attorney, Agent, or Firm*—Paul J. Sutton

(57) ABSTRACT

An electrical plug includes a first portion and a second portion that is matable with the first portion. The second portion has a channel for receiving a wire. The first portion includes at least one prong having a bifurcated contact. The bifurcated contact can pierce an insulation of the wire in the channel and can make contact with at least one conductor of the wire when the first portion is mated with the second portion. The bifurcated contacts are displaced longitudinally from one another along the length of the channel.

2 Claims, 3 Drawing Sheets

QUICK WIRE CONNECT ANGLE PLUG

This application claims the benefit of the filing date of a provisional application having Ser. No. 60/516,621 which was filed on Oct. 31, 2003.

BACKGROUND

A plug can be used for mating with a receptacle to transfer electrical power between two or more electrical components. Appliances for home and commercial use can have one or more wires that extend from the appliance and terminate in a plug at the opposite end of the wire. The plug can have conductive external blades that can be configured to seat into a receptacle outlet that can supply electrical power to the blades and then to the appliance through the wires. The wires may enter the plug either parallel to or at an angle to the blades. The wires may be electrically connected to the blades inside the plug in a variety of methods. One method of connection is by screw terminals where the wire can be positioned under a screw electrically connected to the blade and driving the screw with a screw driver. Soldering is another method of connection in which the wire is placed in electrical contact with the blade and a heating tool melts solder onto the connection. A mechanical connection between the wire and the blade can be made by, for example, by crimping a conductive sleeve with a crimping tool around both the conductor and a blade contact. Insulation displacement connection (IDC) is another way to make electrical contact between the wire and the blade. In an IDC, each blade is electrically connected to a piercing prong that pierces an insulation jacket surrounding a center conductor of each wire and electrically contacts the center conductor.

SUMMARY OF THE DISCLOSURE

The method and apparatus of the present invention disclose an electrical plug having a first portion and a second portion matable with the first portion. The second portion can include a channel for receiving a wire therein. At least one prong is disposed within the first portion. The prong can have a bifurcated contact to pierce a received wire and make contact with at least one conductor of the received wire when the first portion is mated with the second portion.

In an implementation, the bifurcated contact pierces the received wire in two locations offset from one another longitudinally along a length of the channel. In some implementations, the first and second portions are secured together when the portions are mated. Some of the implementations of the disclosure may include one or more of the following advantages. The plug of the present invention is configured to allow a wire having one or more conductors of different types and/or sizes to be pierced without the need for user adjustment. The plug further has a one piece body with a living hinge and provides a method of trapping and positioning the wire to provide stress relief, all without the need for any secondary parts or tools.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

Other aspects, features, and advantages of the present invention will become more fully apparent from the following detailed description, the appended claim, and the accompanying drawings in which similar elements are given similar reference numerals.

DETAILED DESCRIPTION

The plug of the present invention is configured to allow a wire having one or more conductors of different types and/or sizes to be pierced without the need for user adjustment. The connector has a first portion to receive the wire and is matable with a second portion. A piercing prong is disposed within the second portion of the connector. The piercing prong has bifurcated contacts that are positioned longitudinally along a length of the wire. As the two portions mated, the bifurcated contacts pierce an insulation of the wire and can make contact with a conductor therein.

Referring to FIGS. 1–6, there is illustrated an embodiment of the plug of the present invention which includes a plug which can be connected to a two wire flat conductor of at least five different wire sizes without requiring any tools. The techniques and methods disclosed are not limited either with regard to the number of wires or the number of wires sizes that may be accommodated.

Figure 1:
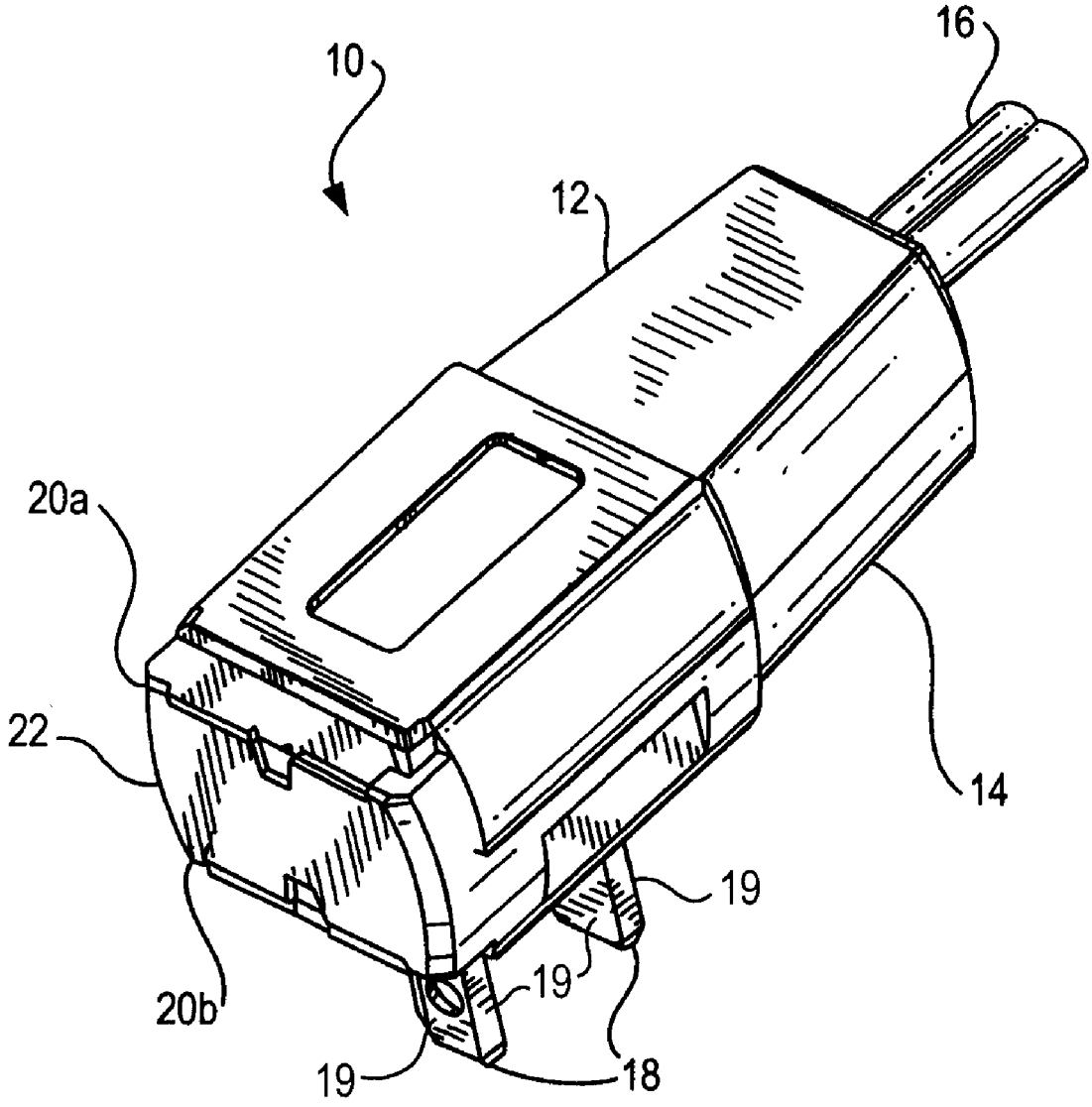
FIG. 1 is a perspective of a plug in accordance with the present invention.
Figure 4:
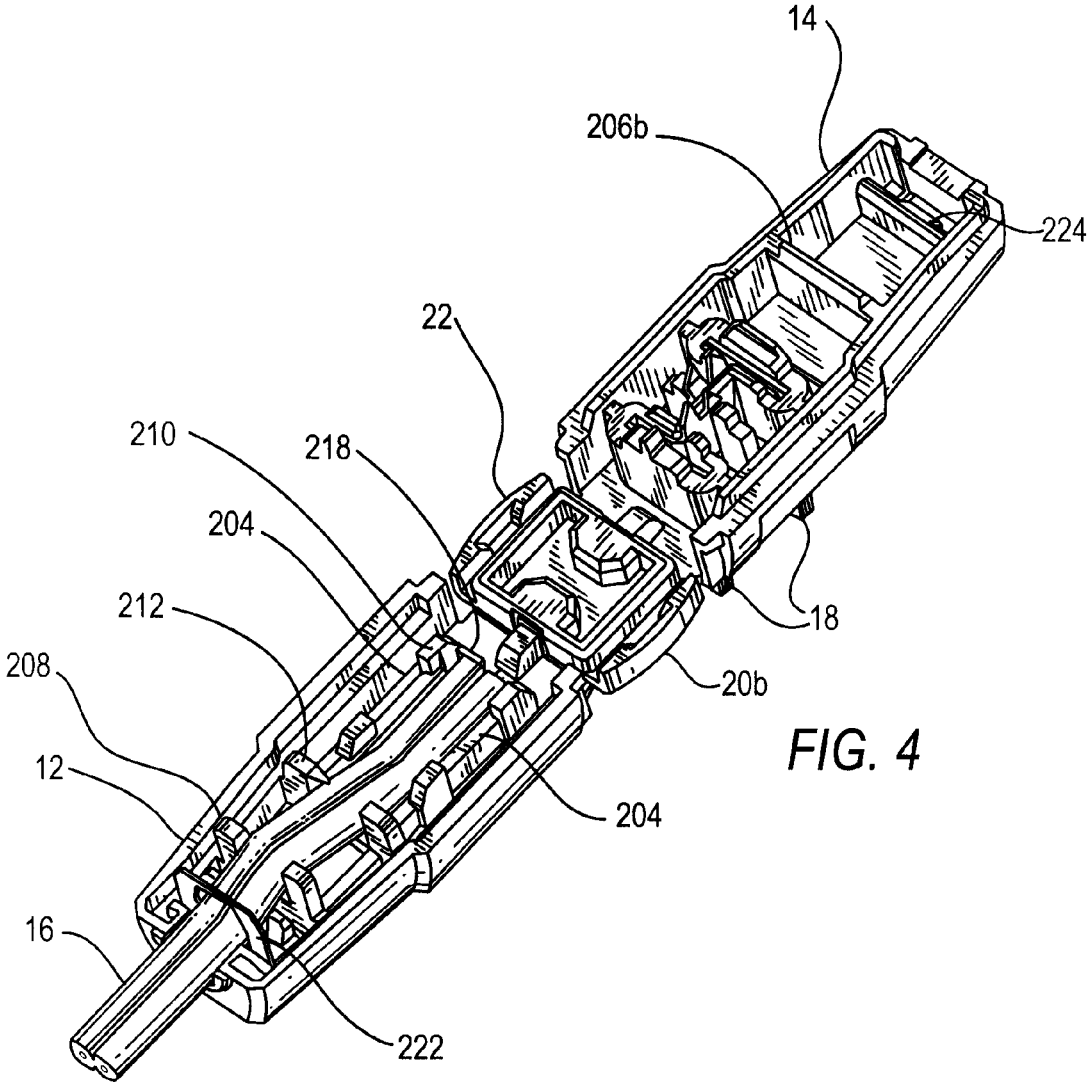
FIG. 4 is a perspective view of the plug of FIG. 1 in the open position including a two wire conductor.

FIG. 1 illustrates an angle plug 10 version of the present invention. The plug includes a first portion 12 and a second portion 14, each of which is connected to a hinge 20*a*, 20*b*, respectively. The first and second portions are rotatably coupled to the hinges to allow the portions to mate with each other as shown in FIG. 1. A wire 16 such as from an appliance can be positioned in the plug 10. Internal piercing prongs in the plug (described below) can couple conductors within the wire to the blades 18. The wire 16 is positioned in the plug 10 when the plug is in its open state as shown in FIG. 4. When the second portion is rotated about hinge 20*b*, each of the piercing prongs can make electrical contact with a conductor in the wire 16 to electrically couple the conductor to the blades 18. At the same time, the wire 16 is captivated between the first and second portions 12, 14. The blades 18 have external wide surface portions 19 which are positioned perpendicular to the longitudinal axis of the wire 16 which allow the plug 10 to be coupled to one outlet of a duplex wall outlet without blocking the other outlet.

Figure 6:
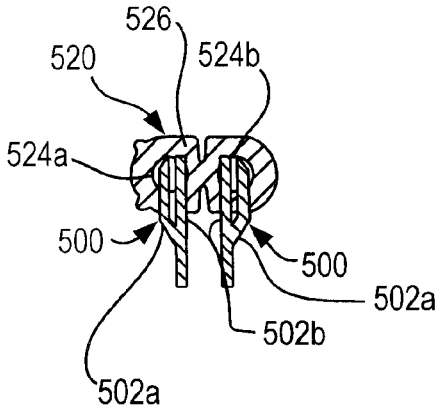
FIGS. 5 and 6 shows the offset design of the piercing prongs enganging a two wire conductor.
Figure 5:
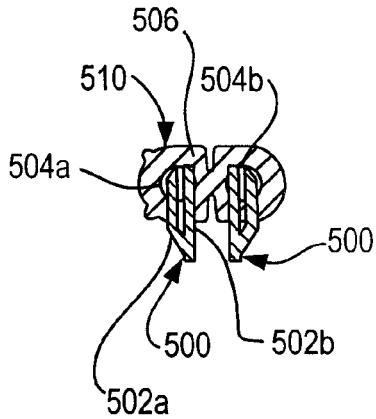

FIGS. 5 and 6 illustrate implementations of piercing prongs 500 that can be used with multiple wire types such as a first wire 510 and a second wire 520, respectively. To illustrate, the first wire 510 is a #18 AWG SPT-1 type and the second wire 520 is a #18 AWG SPT-2 type. The term "AWG" is an acronym for American Wire Gauge which refers to the size of the conductors of a wire (cord) where, for example, a #18 AWG conductor is smaller than a #16

AWG conductor. The term "SPT" is an acronym for Stranded, Parallel Thermoplastic which refers a standard flat cord type where, for example, an SPT-2 cable is a heavier duty cable with larger size insulation over the conductors than an SPT-1 cable. As explained below, the Piercing prongs 500 are capable of being used with different cord types such as SPT-1 (FIG. 5) and SPT-2 (FIG. 6) but with the same #18 AWG conductor, without requiring additional tools or installation steps. Referring to FIG. 5, each prong 500 has bifurcated contacts 502*a*, 502*b*. When the prongs are impressed into a wire 510, the prongs 500 pierce the insulation 506 of the wire 510 and the contacts 502*a*, 502*b* of the prongs come into electrical contact with the conductors 504*a*, 504*b* of the wire 510. The bifurcated contacts 502*a*, 502*b* of the piercing prongs can be positioned in an offset configuration longitudinal to the conductor to insure proper wiring termination regardless of the size of the wire. Because of the offset of the contacts of the prongs, the device can accommodate a variation in the sizes of wire used in the plug. The contacts may be positioned anywhere along the expected cross-section of a conductor 504*a*, 504*b*. Offsetting of the contacts longitudinally with the wire can provide for placement of the contacts horizontally closer together than if the contacts were side by side. This arrangement can insure a proper wiring termination for conductors of small wire gauges such as #18 AWG. FIG. 6 illustrates a similar configuration of prongs 500 to accommodate wire 520 which has a larger insulation covering the conductors than the wire 510 of FIG. 5. When the prongs 500 are impressed into wire 520, the prongs pierce the insulation 526 of the wire and the contacts 502*a*, 502*b* of the prongs come into electrical contact with the conductors 524*a*, 524*b* of the wire 520. Thus, the offset arrangement of the prongs can accommodate multiple wire types and sizes.

Figure 2:
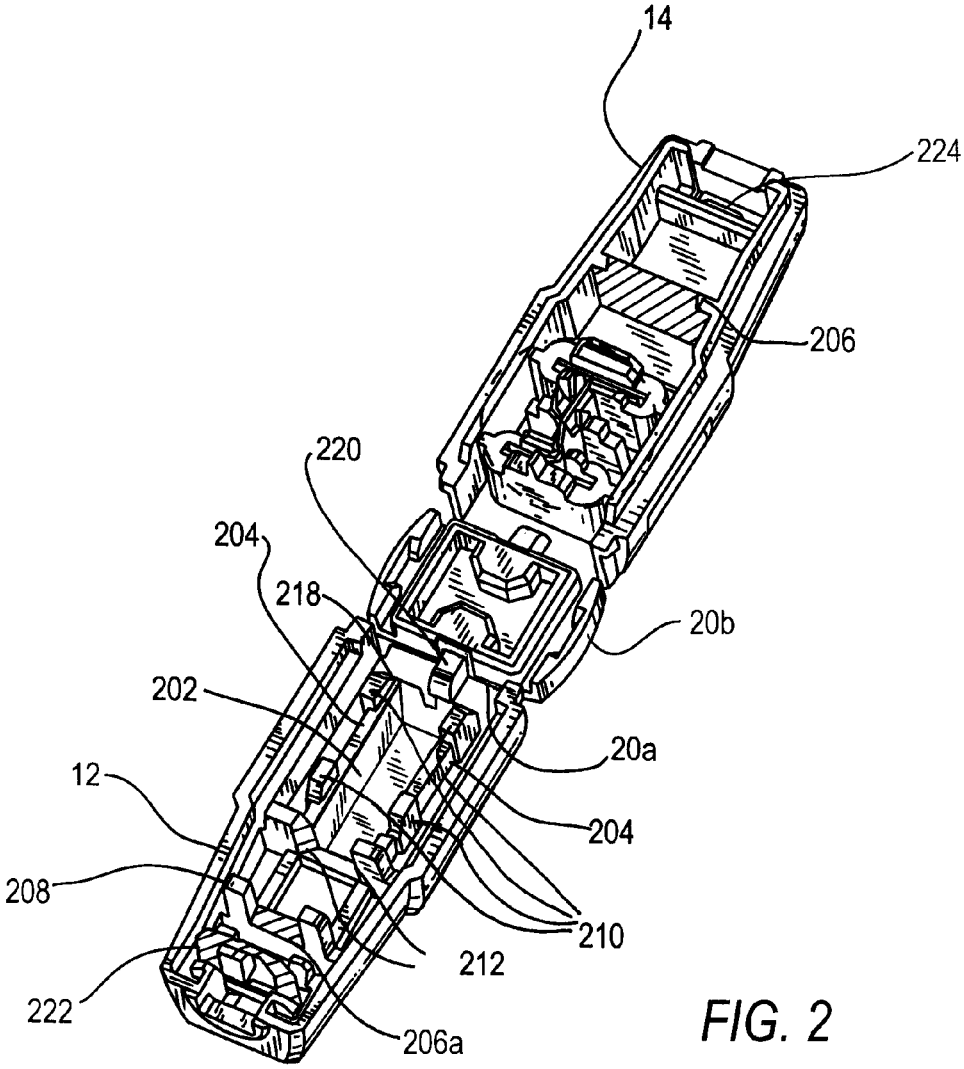
FIG. 2 is a perspective view of the plug of FIG. 1 in the open position prior to receiving a two wire conductor.
Figure 3:
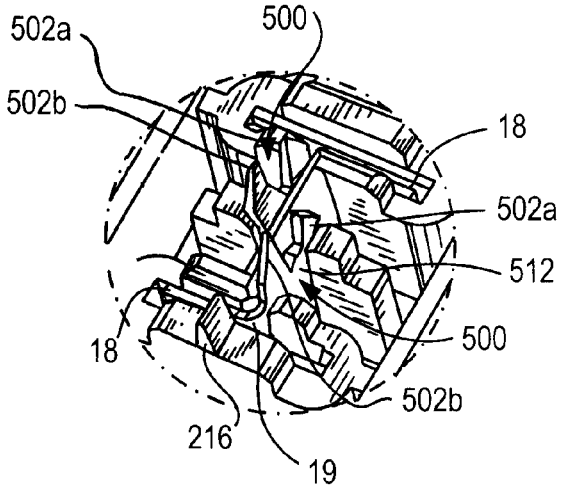
FIG. 3 is an enlarged view of the insulation piercing end of the contact blades positioned within the plug.

FIGS. 2–4 illustrate the internal arrangement of an implementation of an angle plug that may be assembled to an electrical cord without tools. Referring to FIG. 2, a series of main walls 204 perpendicular to a main wire channel 202 can be arranged to trap the wire 16 (see FIG. 4) in the channel 202. One or more stop ribs 218 can provide an end point of the wiring channel 202 and may provide both a limit on the length of wire in the plug and stability of the wire end. Guiding walls 208 may be arranged to offset laterally the wire from a longitudinal axis of the main wire channel 202. Guiding ribs 206*a*, 206*b* can be arranged to offset vertically the wire from the longitudinal axis of the wiring channel 202 and, when the connector is assembled, cause the wire 16 to be in serpentine configuration before entering the wiring channel 202. Referring to FIG. 4, one or more pairs of main locating ribs 210 can both crimp and center the wire in the wiring channel 202. A pair of secondary locating ribs 212 may be provided to crimp and center the wire 16 as it enters the channel 202. The main locating ribs 210 and secondary locating ribs 212 can provide strain relief and aid in the alignment of the wire 16 in the channel 202. The ribs (210, 212) can aid in aligning the wire with piercing prongs 500 (see FIG. 3) located at the ends of each of the plug blades 18. Some wires 16 may have a longitudinal groove in an insulation between conductors in the wire. A splitting rib 216 can be positioned in the plug to impinge in the groove between conductors of such wires 16 when the connector is assembled. Referring to FIG. 3, each blade 18 of the plug includes a piercing prong 500 with two insulation piercing bifurcated contacts 502*a*, 502*b*, positioned to pierce the insulation around the conductor of wire 16 and make contact with the conductor within the wire. In addition, each of the prongs 500 include a wide surface portion 512 which is perpendicular to the wide surface portion 19 of the blade 18. This arrangement, as explained above, allows the plug to be inserted into an outlet of a dual outlet receptacle without blocking the other outlet. The piercing contacts 502*a*, 502*b* can be offset from one another so that multiple sizes of wire and the wire spacing between the two wires may be accurately terminated without the need for any user adjustments. Positioning of the bifurcated contacts 502*a*, 502*b* along the length the wire can permit positioning of the contacts so at least one of the contacts will contact a conductor of the wire. An interlocking rib 220 may be located adjacent the hinge 20*a* and positioned to mate with a complementary counterpart (not shown) when the plug is assembled. A yieldable metal clip 222 is mounted into the internal cavity of the first 12 portion of the plug body and positioned to ride against a barb (not shown), which may be an integral part of the mating portion of the plug. A yieldable plastic tab 224 is mounted into the internal cavity of the second portion 14 of the plug body. The plastic tab 224, which may be an integral part of the mating portion of the plug, is positioned to interlock with an opening of the metal clip 222. For example, when the first 12 and second 14 portions are brought together, the tab 224 interlocks with the opening of the metal clip 22 to secure the first and second portions to each other. An opening (not shown) adjacent the plastic tab 224, which extends through the external surface of the plug body, allows a tool (e.g., blade of a screwdriver) to be inserted into the opening. Once the tool is inserted, the tool can be rotated in such a manner to make contact with the metal clip 222 and urge the metal clip opening away from the tab 224 thereby unlocking the first portion 12 from the second 14 portion and opening the plug. Thus, this locking arrangement provides a detachable mechanism to lock (close) and unlock (open) the plug without the use of fasteners such as screws or adhesives.

The plug may be used with wire #16 AWG wire having insulation types SPT-1 (service parallel thermoplastic), SPT-2 or HPN (heater parallel neoprene) two conductor, flat parallel cable of at least five different sizes including a #18 AWG SPT-1 and SPT-2, #16 AWG SPT-2, and a #18 or #16 AWG HPN. The wire can be pushed through an opening of the metal clip 222 and into the wiring channel 202 until the wire touches the stop rib 218. The guiding walls 202 and guiding rib 206 can cause the wire into a serpentine configuration when placed into the wiring channel and pull the wire inwards creating the slack needed for the main locating ribs 210 to act as a strain relief on the wire. The ribs 210, 212 can prevent the wire from being pulled out of the plug. This may provide the strain relief of the wire 16 in the plug and can be an integral part of the housing. As the wire 16 is pushed down in the wiring channel 202 the main locating ribs 210 align the wire in the channel. The secondary locating rib 212 can help prevent the wire from slipping out of the wiring channel 202 and stop ribs 218 can help prevent the wire from sliding too far into the body of the plug. After the wire is inserted into the channel, the first and second portions are rotated about hinges 20*a*, 20*b*. The splitting rib 216 is positioned in the plug to enter into a center groove in the insulation of the wire between conductors. As the first and second portions 12, 14 are rotated about hinges 20*a*, 20*b* so one portion mates with the other, the splitting rib 216 can separate the two parts of the wire 16 to help prevents any stray strands from shorting out across the cable. As the plug is closed, the piercing contacts 502*a*, 502*b* pierces the insulation of the wire 16 and make electrical contact with the conductor within the insulation. After the wire 16 is pushed through the opening of the metal clip 222, it is seated firmly in the wiring channel up against the ribs 210, 212. As the first and second portions 12, 14 of the plug are closed, the following operations are performed, substantially simultaneously: the mated first and second portions of the plug are held together with the clip 222 that springs inward at the top of a barb (NOT SHOWN) and holds the first and second portions in place.

While there have been shown and described and pointed out the fundamental novel features of the invention as applied to the preferred embodiment, it will be understood that various omissions and substitutions and changes of the form and details of the method and apparatus illustrated and in the operation may be done by those skilled in the art, without departing from the spirit of the invention.

What is claimed is:

1. An electrical plug comprising:

a first portion;

a second portion mateable with the first portion and having a channel for receiving a wire;

at least one prong disposed within the first portion and having a bifurcated contact to pierce a received wire and make contact with at least one conductor of the received wire when the first portion is mated with the second portion, wherein the bifurcated contact pierces the received wire in two locations offset from one another longitudinally along a length of the channel; and an assembly clip disposed at an end of the first portion, wherein, an entry opening to the plug is formed when the first and second portions are brought together, wherein the assembly clip secures the first and second portions together.

2. A plug comprising:

a first portion;

a second portion mateable and pivotally coupled to the first portion, wherein the first portion comprises:

a wiring channel to receive a wire having one or more insulated conductors;

a first guiding rib positioned to engage the wire in the wiring channel and offset the wire in a vertical direction from the wiring channel;

a rib positioned to engage and secure the wire in the wiring channel from being pulled out of the channel when the first and second portions are mated together; and a stop rib to restrict the length of the wire that can be inserted into the channel, wherein the second portion comprises:

a second guiding rib to cause the wire into a serpentine configuration in a vertical direction with respect to the wiring channel when the first and second portions are pivoted together;

a splitting rib to separate ends of the conductors of the wire in the channel;

one or more electrically conductive blades, one or more piercing prongs having a bifurcated contact, each piercing prong electrically coupled to an associated blade and wherein the contacts are offset from one another in a longitudinal direction of the wire channel.

* * * * *